US006644563B2

(12) United States Patent
Presson

(10) Patent No.: US 6,644,563 B2
(45) Date of Patent: Nov. 11, 2003

(54) COMBINED PORTABLE, CLEANING FLUID SPRAY APPARATUS AND PAPER TOWEL SUPPORT AND DISPENSING APPARATUS

(76) Inventor: Kirk L. Presson, 355 E. Sprague Rd., Seven Hills, OH (US) 44131

( * ) Notice: Subject to any disclaimer, the term of this patent is extended or adjusted under 35 U.S.C. 154(b) by 0 days.

(21) Appl. No.: 09/748,532

(22) Filed: Dec. 26, 2000

(65) Prior Publication Data

US 2002/0079380 A1 Jun. 27, 2002

(51) Int. Cl.[7] ..... B05B 15/00
(52) U.S. Cl. ..... 239/289; 239/333; 222/192
(58) Field of Search ..... 239/289, 333; 222/192; 206/226

(56) References Cited

U.S. PATENT DOCUMENTS

| | | | | | |
|---|---|---|---|---|---|
| 1,255,772 | A | * | 2/1918 | Miller | 206/226 |
| 1,582,645 | A | * | 4/1926 | Findley | 206/226 |
| 4,436,224 | A | * | 3/1984 | McInerny | 221/96 |
| 4,516,676 | A | * | 5/1985 | Cournoyer | 206/225 |
| D307,843 | S | | 5/1990 | Parshall | |
| 5,271,682 | A | | 12/1993 | Realdon | |
| 5,364,198 | A | | 11/1994 | Skenderi | |
| 5,439,104 | A | | 8/1995 | Wolska-Klis | |
| D363,214 | S | | 10/1995 | Parola et al. | |
| 5,671,872 | A | * | 9/1997 | Daniels, Jr. | 222/192 |
| 5,775,591 | A | | 7/1998 | Fauci | |
| 5,819,989 | A | * | 10/1998 | Saraceni | 222/192 |
| D406,976 | S | | 3/1999 | Baggett | |
| 5,967,345 | A | | 10/1999 | Subotin | |
| 5,979,849 | A | | 11/1999 | Williams | |
| 6,138,874 | A | * | 10/2000 | Audrey | 221/45 |
| 6,216,920 | B1 | * | 4/2001 | Baggett | 222/192 |

* cited by examiner

*Primary Examiner*—Steven J. Ganey
(74) *Attorney, Agent, or Firm*—John D. Gugliotta; P. Jeff Martin

(57) ABSTRACT

A combined portable, cleaning fluid spray apparatus and paper towel support and dispensing apparatus is provided which combines the functions of a liquid window cleaner spray dispenser and a paper towel roll holder into one product. A long, tube-type arrangement fits inside a roll of paper towels, and the lower portion of the tube comprises a base which holds used and discarded paper towels in a lower compartment. A standard pump sprayer at the top connects to the tube with a threaded connection. An upper plate-type washer along with a tension rod provides a method of restraining the paper towels when not being used, as well as an easy means to tear off the paper towels during use.

8 Claims, 10 Drawing Sheets

COMBINED PORTABLE, CLEANING FLUID SPRAY APPARATUS AND PAPER TOWEL SUPPORT AND DISPENSING APPARATUS

RELATED APPLICATIONS

The present invention was first described in Disclosure Document No. 477,952 filed on Aug. 4, 2000. There are no previously filed, nor currently any co-pending applications, anywhere in the world.

BACKGROUND OF THE INVENTION

1. Field of the Invention

The present invention relates generally to window cleaning devices and, more particularly, to a combined portable cleaning fluid spray apparatus and paper towel support and dispensing apparatus.

2. Description of the Related Art

The old saying, "I don't do windows" is a sentiment shared by many. Most people find it tiresome, boring and perhaps difficult to do. Additionally as one walks around the inside or outside of a home or building cleaning windows, one must carry cleaning agent, clean towels, and the used towels. It is also necessary to repeatedly pickup and set down these items during the cleaning process, so that at least one hand may be free to clean the windows. In doing so, it is easy to soil the clean roll of paper towels, perhaps even ruining the entire roll. If one decides to leave the soiled paper towels at each window, one must retrace their steps to retrieve them all when completed.

Accordingly, there exists a need for a means by which windows can be cleaned in a quick, easy and effective manner without the disadvantages described above. The development of the combined portable cleaning fluid spray apparatus and paper towel support and dispensing apparatus fulfills this need.

A search of the prior art did not disclose any patents that read directly on the claims of the instant invention; however, the following references were considered related. The following patents disclose an eyeglass cleaning station with cleaner bottle and tissue supply: U.S. Pat. No. 5,979,849 issued in the name of Williams; and U.S. Pat. No. 5,439,104 issued in the name of Wolska-Klis.

The following patents describe a squeegee device for cleaning windows with a holder and a fluid supply: U.S. Pat. No. 5,364,198 issued in the name of Skenderi; and U.S. Pat. No. 5,271,682 issued in the name of Realdon.

U.S. Pat. No. 5,967,345 issued in the name of Subotin discloses a baby bottle and accessories holder.

The following patents describe the ornamental design for a combined spray bottle and paper towel holder: U.S. Pat. No. D 406,976 issued in the name of Bagget; U.S. Pat. No. D 363,214 issued in the name of Parola et al.; and U.S. Pat. No. D 307,843 issued in the name of Parshall.

U.S. Pat. No. 5,775,591 issued in the name of Fauci discloses a portable pressure cleaning device with means to carry cleaning accessories.

Consequently, a need has been felt for providing a means for one person to quickly clean windows in a safe, easy, and effective manner.

SUMMARY OF THE INVENTION

Therefore, it is an object of the present invention to provide a combination paper towel dispenser and window cleaning fluid sprayer which allows for quick and easy cleaning of windows.

It is another object of the present invention to provide a combination paper towel dispenser and window cleaning fluid sprayer which prevents the need for picking up and setting down cleaning items.

It is another object of the present invention to provide a combination paper towel dispenser and window cleaning fluid sprayer which allows one hand to always remain free for cleaning windows.

It is still another object of the present invention to provide a combination paper towel dispenser and window cleaning fluid sprayer which saves time and is convenient.

It is still another object of the present invention to provide a combination paper towel dispenser and window cleaning fluid sprayer which prevents the need for carrying separate items.

It is another object of the present invention to provide a combination paper towel dispenser and window cleaning fluid sprayer which allows for no dropped or wasted items.

It is another object of the present invention to provide a storage tube which holds paper towels on the outside.

It is another object of the present invention to provide a storage tube which holds cleaning fluid on the inside.

It is another object of the present invention to provide a used towel storage compartment which is located on the base of the invention.

It is another object of the present invention to provide a used towel storage compartment wherein used towels are quickly inserted in the side of the apparatus.

It is another object of the present invention to provide a used towel storage compartment which when filled or near a trash container, a trap door on the bottom allows emptying of used towel storage.

It is another object of the present invention to provide a used towel storage compartment which prevents the carrying of dirty, used towels.

It is another object of the present invention to provide a used towel storage compartment which provides less chance of towels blowing away and becoming litter.

It is another object of the present invention to provide a roll storage system which includes an upper plate-type washer which holds the paper roll firmly.

It is another object of the present invention to provide a roll storage system which includes a tension rod which prevents the paper roll from unraveling and permits easy and quick tearing of paper towels.

It is another object of the present invention to provide a roll storage system which holds a standard sized roll of towels.

It is another object of the present invention to provide a fluid reservoir located in the storage tube and in the base of the apparatus.

It is another object of the present invention to provide a fluid reservoir which holds a large quantity of cleaning fluid for big window washing jobs, and can be easily refilled when empty.

Briefly described according to one embodiment of the present invention, a combined portable, cleaning fluid spray apparatus and paper towel support and dispensing apparatus is provided which combines the functions of a liquid window cleaner spray dispenser and a paper towel roll holder into one product. The invention consists primarily of a long, tube-type arrangement that fits inside a roll of paper towels.

The lower portion of the tube comprises a base which holds used and discarded paper towels in a lower compartment. The lower compartment has a side opening wherein the used towels can be placed. The lower compartment also has a bottom trap door opening which allows all of the used paper towels to be discarded when near a trash collection bin or at the completion of window cleaning. The base of the invention also forms a reservoir for the storage of window cleaning fluid along with the interior of the tube assembly. The top of the invention is fitted with a standard pump sprayer which connects to the tube with a threaded connection. An upper plate-type washer along with a tension rod provides a method of restraining the paper towels when not being used, as well as an easy means to tear off the paper towels during use.

The use of the present invention provides a means for one person to quickly clean windows in a safe, easy, and effective manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
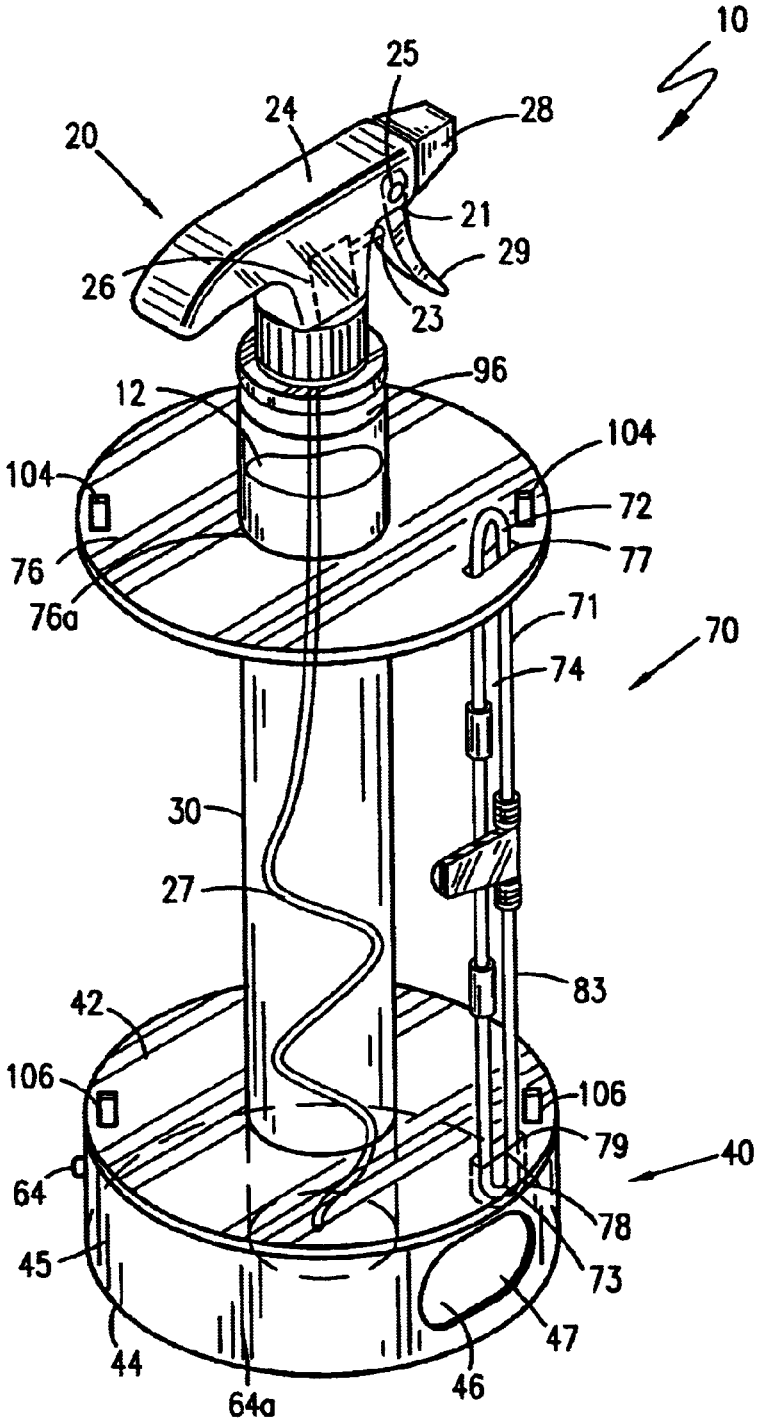
FIG. 1 is a perspective view of a combined portable cleaning fluid spray apparatus and paper towel support and dispensing apparatus according to the preferred embodiment of the present invention.
Figure 2:
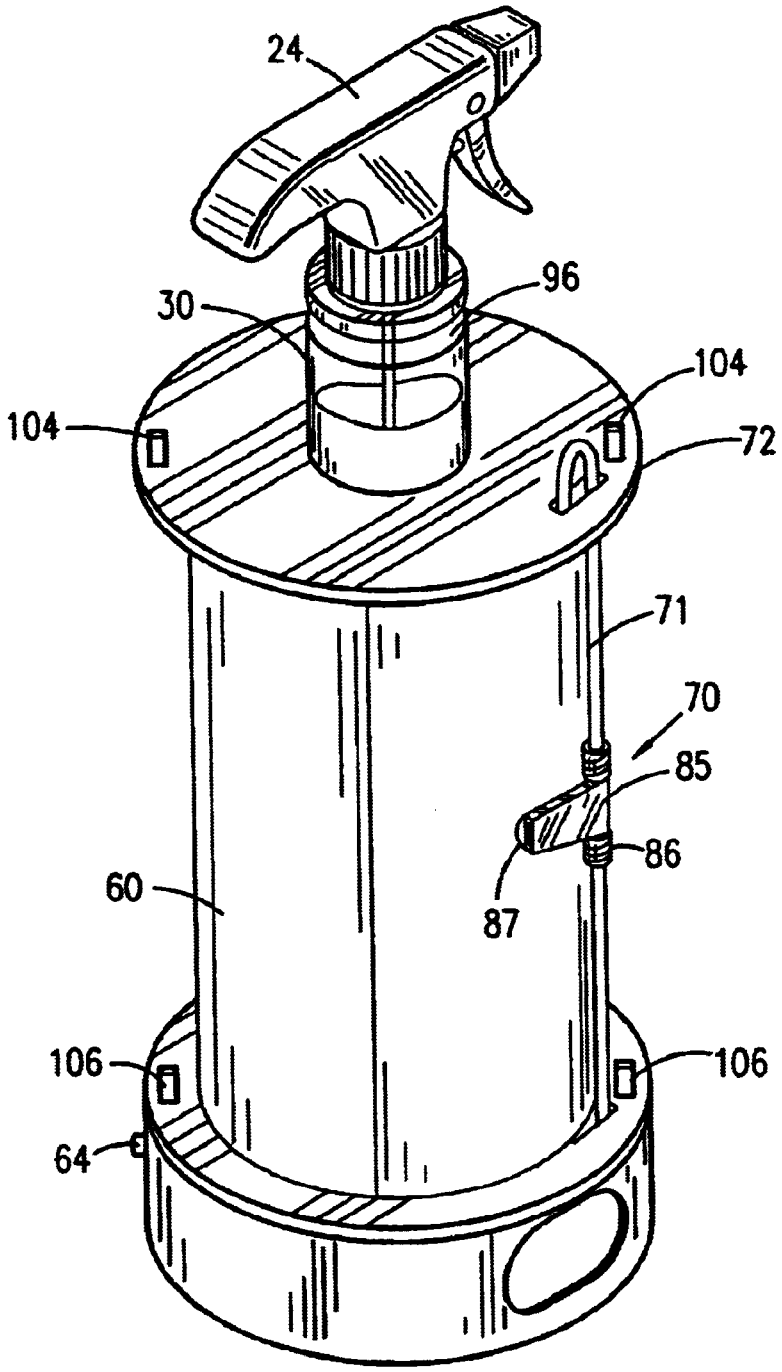
FIG. 2 is a perspective view of the present invention according to the preferred embodiment shown supporting a roll of paper towels.
Figure 3:
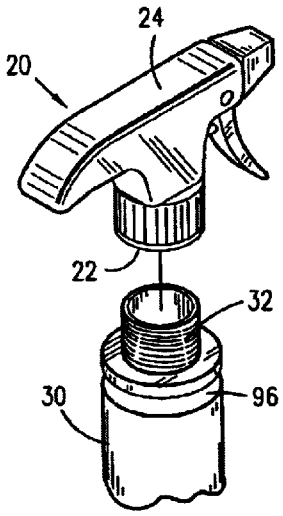
FIG. 3 is an exploded perspective view of the spray head and the reservoir cylinder.

Referring now to FIGS. 1–3, a combined portable cleaning fluid spray apparatus and paper towel support and dispensing apparatus 10 is shown, according to the present invention, comprised of a manually actuable spray apparatus 20, a cleaning fluid reservoir cylinder 30, a base 40, and a paper roll retaining and dispensing apparatus 70.

The cleaning fluid reservoir cylinder 30 is of a linearly elongated, hollow tubular configuration constructed of a clear, plastic material. The reservoir cylinder 30 is designed and configured for both storing a supply of cleaning fluid 12, and for supporting a roll of paper towels 60 in an upright manner. A hollow center of a roll of paper towels 60 is designed to mate with the reservoir cylinder 30 in such a manner wherein the hollow center slidably receives the reservoir cylinder 30. The reservoir cylinder 30 further acts as an axis about which a roll of paper towels 60 rotates.

The manually actuable spray apparatus 20 is frictionally attached to the reservoir cylinder 30 through the provision of the reservoir cylinder 30 being provided with a threaded male fitting 32 located at an upper end thereof for threadably engaging a threaded female fitting 22 provided on a lower side of a spray head 24 of the spray apparatus 20.

A fluid pump 26, located within the spray head 24 and of a type well known in the art, forces cleaning fluid 12 from the reservoir cylinder 30 into and through a flexible syphon tube 27 and exits a spray nozzle 28. The fluid pump includes a depressible trigger 29 pivotally attached via a pivot pin 25 to the spray head 24, wherein the trigger 29 extends outward through a slot 21 provided in the spray head 24. The trigger 29 is designed so as to be easily depressed by a finger of a user. The trigger 29 is connected to the fluid pump 26 via a push rod 23 which actuates the fluid pump 26. The syphon tube 27 is of a linearly elongated configuration and extends downward to a position near a bottom of the reservoir cylinder 30. The syphon tube 27 extends into and exits the fluid pump 26 and extends to the spray nozzle 28 which is mounted to an end of the spray head 24. The syphon tube 27 is of a length which allows the spray apparatus 20 to be removed from the reservoir cylinder 30 while a lower end of the syphon tube 27 remains in the cleaning fluid 12, thereby allowing a user to spray cleaning fluid 12 in areas which would otherwise be impractical to do so.

Figure 4:
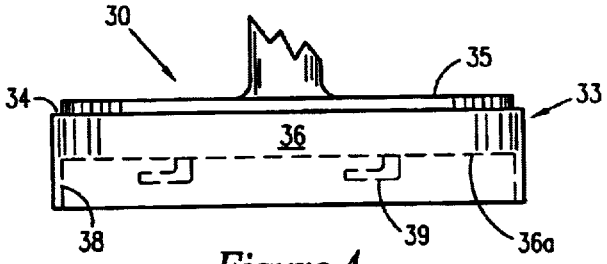
FIG. 4 is a side elevational view of the reservoir cylinder according to the preferred embodiment of the present invention.
Figure 5:
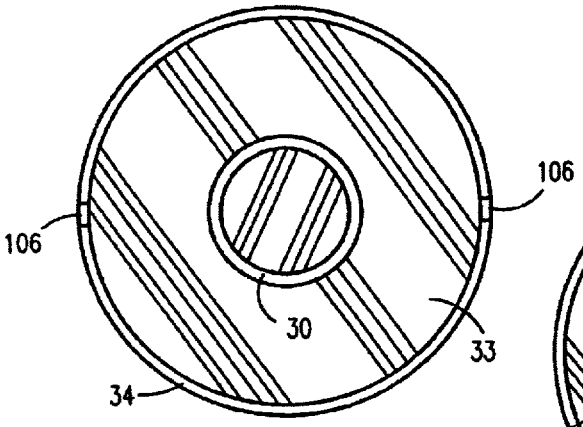
FIG. 5 is a top plan view thereof.
Figure 6:
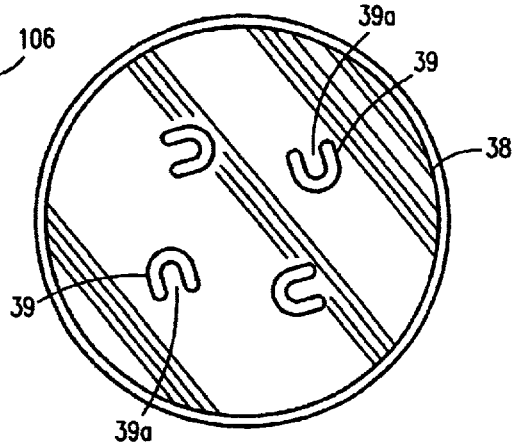
FIG. 6 is a bottom plan view thereof.

Referring now to FIGS. 4–6, the reservoir cylinder 30 is further defined as having a circular skirt structure 33 molded integral therewith which extends radially from a sidewall of a lower portion thereof. An upper, outer perimeter of the skirt structure 33 is defined as having a cylindrical housing receiving edge 34 formed peripherally therearound as an angular recess between an upper surface 35 of the skirt structure 33 and a circular apron thereof 36. A lower, inner perimeter of the skirt structure 33 is defined as having a base receiving edge 38 formed peripherally therearound as an angular recess between a lower surface 36*a* of skirt structure 33 and a lower inner sidewall of the circular apron 36 thereof.

A plurality of C-shaped, hollow, sleeved fasteners 39 are molded integral to the lower surface 36 of the skirt structure 33. The fasteners 39 are designed so as to slidably receive corresponding attachment stems 41 of the base 40 (to be described in greater detail below) in a snug manner for allowing the reservoir cylinder 30 to be removably secured to the base 40.

Figure 7:
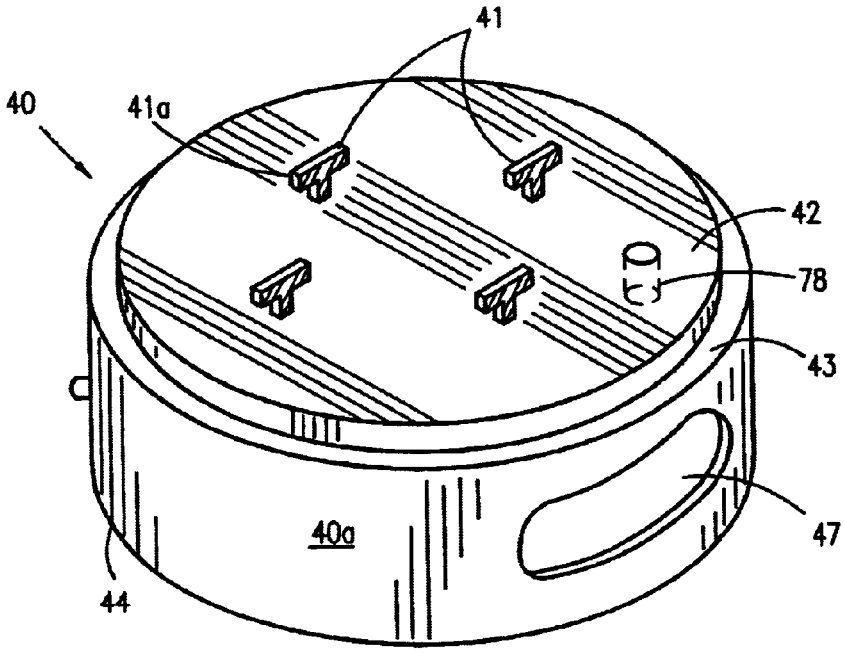
FIG. 7 is a perspective view of the base according to the preferred embodiment of the present invention.
Figure 8:
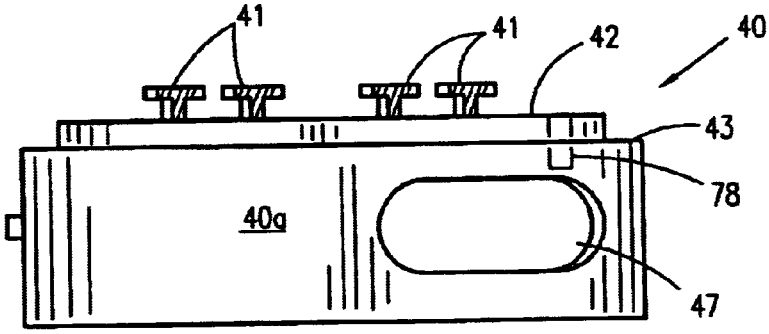
FIG. 8 is a side elevational view thereof.
Figure 9:
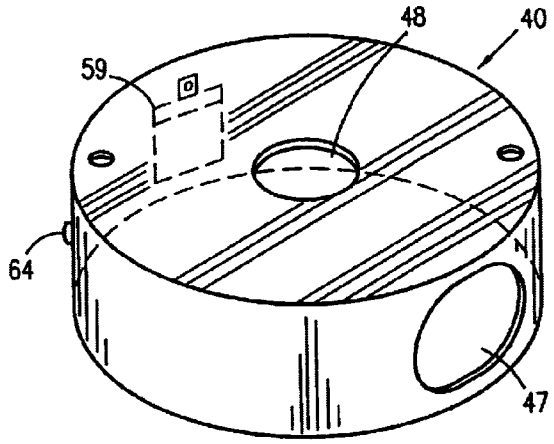
FIG. 9 is a side elevational view of the portable cleaning fluid tank shown positioned within the base.
Figure 10:
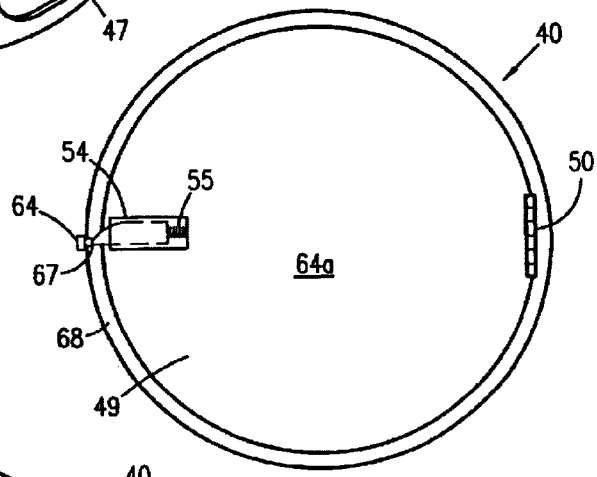
FIG. 10 is a top plan view of an interior of the base.
Figure 11:
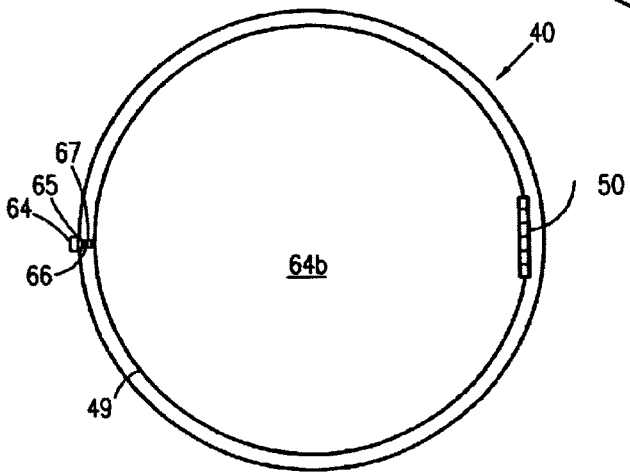
FIG. 11 is a bottom plan view of the base according to the preferred embodiment of the present invention.
Figure 12:
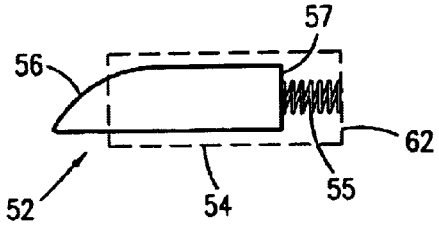
FIG. 12 is side elevational view of the closure latch and housing according to the preferred embodiment of the present invention.
Figure 13:
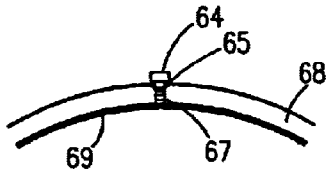
FIG. 13 is a partial side elevational view of the inner sidewall of the bottom side of the base.

Referring now to FIGS. 7–9, the base 40 is of a circular, hollow configuration fabricated of a rigid plastic material with an upper surface 42 opposite a lower surface 44, and a circular apron 40*a* which form a used towel storage compartment 46. A large circular opening 47 formed along the circular apron 40*a* provides entry into the storage compartment 46, wherein used towels are inserted through the opening 47 and stored within the compartment 46. The upper surface 42 of the base 40 serves as a platform upon which the roll of paper towels 60 rest.

Attachment stems 41 are molded integral to the upper surface 42 of the base 40 and extend perpendicularly therefrom. Each attachment stem 41 comprises a circular, flattened head 41*a* adapted so as to be snugly received by a corresponding fastener 39.

An upper, outer perimeter of the base 40 is defined as having a skirt structure receiving edge 43 formed peripherally therearound as an angular recess between an upper surface 42 of the base 40 and a circular apron 40*a* thereof.

The base receiving edge 38 of the skirt structure 33 is designed to coincide with the skirt structure receiving edge 43 of the base 40 in such a manner whereby adjoinment of the reservoir cylinder 30 to the base 40 forms a smooth outer surface at an outer adjoinment point thereof.

The base 40 is further defined as having a portable cleaning fluid tank 90 removably positioned therein for the storage of a supply of cleaning fluid 12. The cleaning fluid tank 90 provides the user with an additional supply of cleaning fluid 12 should the need arise.

It is envisioned that a removably attachable base 40 measuring approximately ⅓ larger in size, and being otherwise identical in design and configuration is provided so as to accommodate a greater number of used towels when encountering larger cleaning jobs.

In order to effectuate securement of the reservoir cylinder 30 to the base 40, a user aligns the reservoir cylinder 30 directly above the upper surface 42 of the base 40 in such a manner wherein the heads 41*a* of the attachment stems 41 reside just shy a head receiving slot 39*a* formed in each fastener 39. The user then simply rotates the reservoir cylinder 30 approximately ⅛ turn in a clockwise direction, thereby securing the heads 41*a* of the attachment stems 41 within the fasteners 39, and effectively securing the reservoir cylinder 30 to the base 40.

Referring now in greater detail to FIGS. 10–13, the lower surface 44 of the base 40 is defined as having an upper portion 64*a* opposite a lower portion 64*b* with a circular trap door 49 attached by a hinge 50 thereto. The trap door 49 is defined as having a linearly elongated spring-biased closure latch 52 with a progressively tapering, narrowed, curved end 56 which forms an acute angle opposite a flat end 57 which forms a 90° angle with respect to an upper surface 59 of the trap door 49. The closure latch 52 rests within a rectangular housing 54 mounted to the upper portion 64*a* of the trap door 49. A spring 55, mounted between the flat end 57 of the closure latch 52 and an end wall 62 of the housing 54, spring biases the closure latch 52 to a protruding position outside an entrance of the housing 54.

In order to maintain the trap door 49 in a closed position, the curved end 56 of the closure latch 52 mechanically interferes with an inner sidewall 69 positioned between the upper and lower portions 64*a*, 64*b* respectively, of the lower surface 44 of the base 40, thereby facilitating retraction of the closure latch 52 within the housing 54. Upon clearing the inner sidewall 69, thus removing mechanical interference between the curved end 56 of the closure latch 52 and the inner sidewall 69, the closure latch 52 is biased to the protruding position, transverse and perpendicularly with respect to an inner rim 68. Mechanical interference between the curved end 56 of the closure latch 52 and the inner rim 68 maintains the trap door 49 in a closed position.

In order to facilitate opening of the trap door 49, a button 64 extends through a hole 65 in the circular apron 40*a* of the base 40 and is biased lateral with respect to the circular apron 40*a* by spring 66. A linearly elongated release arm 67 is mounted linear to an end of the button 64. Pressure exerted on the button 64 actuates the release arm 67 to engage the closure latch 52 in such a manner whereby the closure latch 52 is retracted within the housing 54, thereby removing mechanical interference between the closure latch 52 and the inner rim 68 of the upper portion 64*a* of the lower surface 44 of the base 40, and allowing the trap door 49 to swing downward to an open position. The trap door 49 facilitates an easy manner for discarding used paper towels stored within the base 40. When near a trash collection bin or other waist receiving container, the trap door 40 allows the user to easily discard used paper towels in a quick and efficient manner.

Referring now to FIGS. 1 and 2, in order to facilitate restrainment of a roll of paper towels 60 as well as to provide a means for easily tearing single sheets therefrom, a retaining and dispensing apparatus 70 is comprised of a linearly elongated retaining rod 71 having an anterior end 72 opposite a posterior end 73 and includes an elongated towel receiving slot 74 formed therein.

The retaining and dispensing apparatus 70 further includes a disc-shaped upper plate 76 with a reservoir cylinder receiving hole 76*a* formed centrally therein. The upper plate 76 is designed and configured to mate with the upper end of the reservoir cylinder 30, while a lower surface of the upper plate 76 rests against a top end of an upright roll of paper towels 60 which is supported on a lower end thereof by the base 40 and is supported vertically by the reservoir cylinder 30.

An oval-shaped hole 77 formed in the upper plate 76 is designed so as to removably receive the anterior end 72 of the retaining rod 71.

A retaining rod sleeve 78 with a generally oval-shaped opening 79 leading therein is formed integral on the upper surface 35 of the skirt structure 33 of the reservoir cylinder 30 and extends therefrom through an upper surface 42 of the base 40. The posterior end 73 of the retaining rod 71 is inserted through the opening 79 and is frictionally received within the retaining rod sleeve 78 in a semi-interference type fit, thus immobilizing the retaining rod 71.

Figure 14:
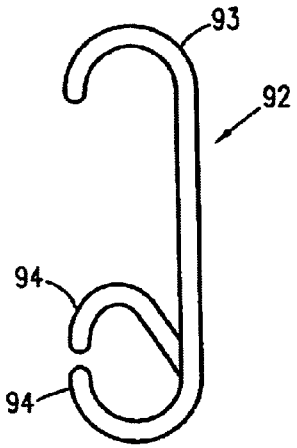
FIG. 14 is a side elevational view of the hook apparatus according to the preferred embodiment of the present invention.

Referring now to FIGS. 1 and 14, in order to allow the present invention to be hung for storage, a hook apparatus 92 of an elongated rod-like configuration, constructed of a rigid plastic material, has an upper end formed of a J-shaped hook 93, and a lower end which has a pair of probes 94 forming a C-shape extending perpendicularly therefrom. Just below the threaded male fitting 32 of the reservoir cylinder 30, a hook receiving groove 96 is formed circumferentially therearound. The hook receiving groove 96 is designed so as to frictionally receive the probes 94 of the hook apparatus 92 therearound in a semi-interference type fit. The hook apparatus 92 provides a means for hanging the present invention on a ladder rung, a railing, in a closet, or other area for temporary or permanent storage.

Figure 15:
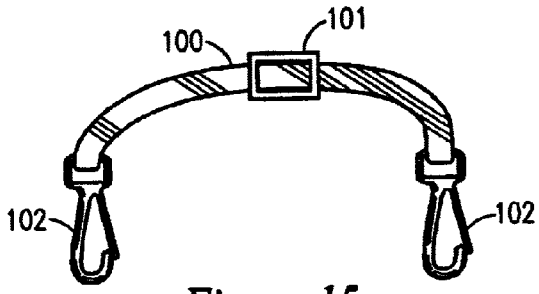
FIG. 15 is a perspective view of the nylon strap according to the preferred embodiment of the present invention.

Referring now to FIGS. 1, 2, and 15, in order to facilitate carrying the present invention when hands of a user are occupied, a convenient nylon shoulder strap 100 with plastic hook ends 102 is provided. Rectangularly shaped apertures 104, 106 formed near opposed edges of upper plate 76, and along opposed cylindrical housing receiving edges 34 of the reservoir cylinder 30 respectively, are provided so as to allow removable connection of the hook ends 102 thereto. The shoulder strap 100 includes plastic, adjustable clips 101 facilitating various adjustable, linear strap 100 lengths.

Figure 16:
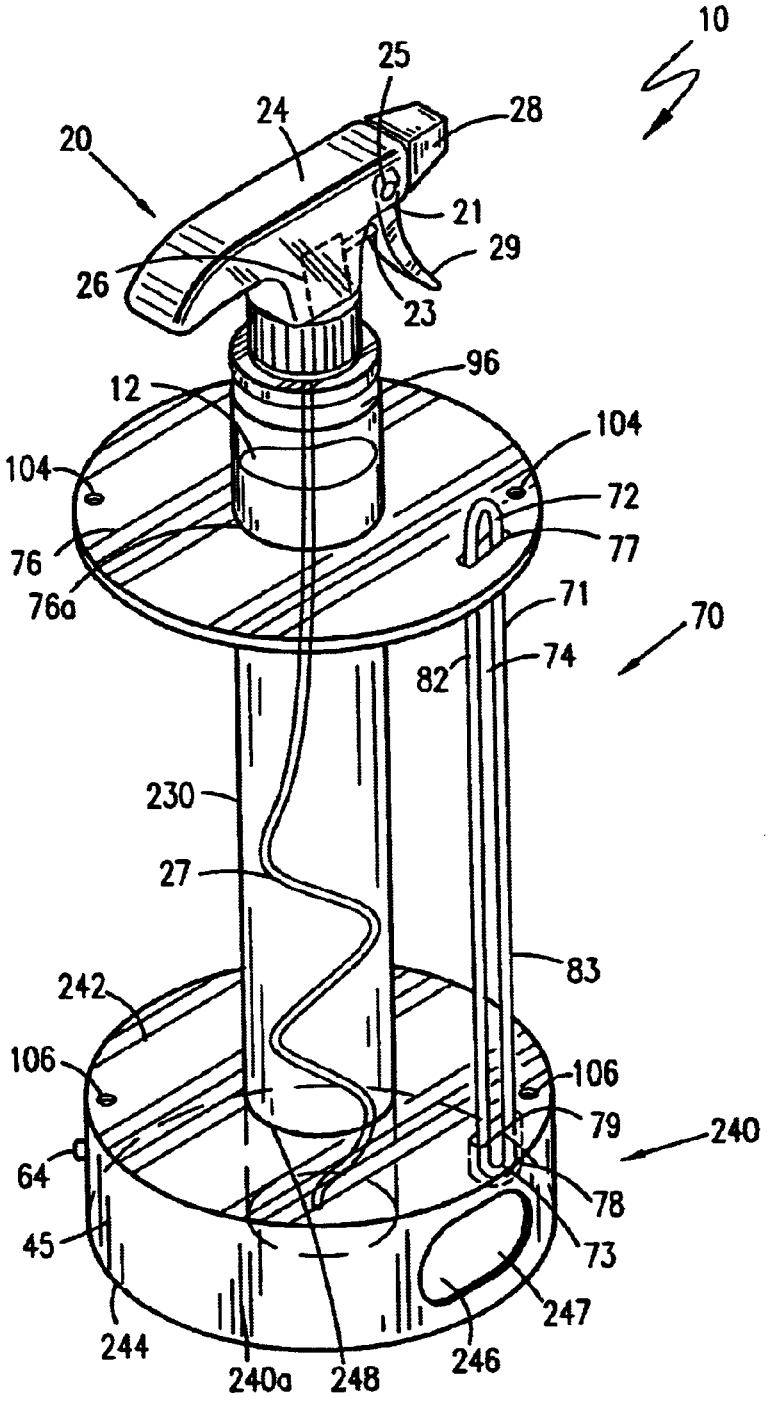
FIG. 16 is a perspective view of a first alternate embodiment of the present invention.

Referring now to FIG. 16, a first alternate embodiment of the present invention is shown, wherein a cleaning fluid reservoir cylinder 230 is of a linearly elongated, hollow tubular configuration constructed of a clear, plastic material. The reservoir cylinder 230 is designed and configured for both storing a supply of cleaning fluid 12, and for supporting a roll of paper towels 60 in an upright manner. A hollow center of a roll of paper towels 60 is designed to mate with the reservoir cylinder 230 in such a manner wherein the hollow center slidably receives the reservoir cylinder 230. The reservoir cylinder 230 further acts as an axis about which a roll of paper towels 60 rotates.

The first alternate embodiment includes a base 240 of a circular, hollow configuration fabricated of a rigid plastic material with an upper surface 242 opposite a lower surface 244, and a circular apron 240*a* which form a used towel storage compartment 246. A large circular opening 247 formed along the circular apron 240*a* provides entry into the storage compartment 246, wherein used towels are inserted through the opening 247 and stored within the compartment 246. The upper surface 242 of the base 240 serves as a platform upon which the roll of paper towels 60 rest.

The upper surface 242 is further defined as having a frictional gripping slot 248 centrally formed therein and extends downward near a top side of the lower surface 244 of the base 240, for removably receiving a lower end of the reservoir cylinder 230 therein. The frictional gripping slot 248 is adapted so as to conform to and securely grip the lower end of the reservoir cylinder 230.

Referring now to FIGS. 17*a*–17*d*, a second alternate embodiment of the present invention is shown which includes a linearly elongated protective cylinder 120 comprised of two semi-cylindrical halves 120*a*, 120*b* attached by a hinge 121 which is visible only from an interior 121*a* thereof. The protective cylinder 120 is fabricated of a lightweight, rigid plastic material.

An upper plate receiving notch 140 is formed circumferentially around inner sidewalls of both an upper and a lower portion of each semi-cylindrical half 120*a*, 120*b*. When in a closed position, the semi-cylindrical halves 120*a*, 120*b* of the protective cylinder 120 form a linearly elongated towel receiving slot 112 located opposite of hinge 121, wherein the semi-cylindrical halves 120*a*, 120*b* slightly overlap, thereby facilitating insertion of paper towels therethrough.

The protective cylinder 120 further comprises a lip 142 formed along both inner, upper and lower portions of each semi-cylindrical half 120*a*, 120*b* for facilitating removable attachment thereof to a spray attachment apparatus housing 122 (to be described in greater detail below).

In order to facilitate tearing of single paper towel sheets, semi-cylindrical half 120*a* includes an inner vertical, laterally directed, sharpened cutting edge 114.

The design and configuration of the protective cylinder 120 provides ends being mutually substitutable. For purposes of this disclosure, the term mutually substitutable is defined as meaning either end of the protective cylinder 120 is equally operable for removably attaching the protective cylinder 120 to the upper plate 76 and skirt structure 33 of the preferred embodiment of the present invention, thus providing a device accommodating left-handed and right-handed operators.

In order to maintain the protective cylinder 120 in a closed position, a plastic clip 116, integrally formed on an internal vertical sidewall of semi-cylindrical half 120*b*, is adapted so as to allow removable connection thereof in a semi-interference type fit to a rib 117 formed integral along an internal vertical sidewall of semi-cylindrical half 120*a*.

Figure 17A:
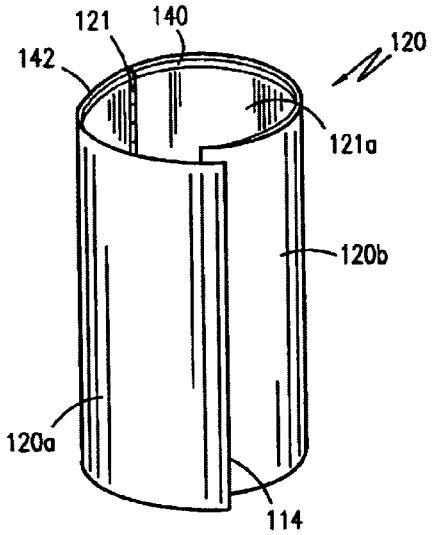
FIGS. 17*a*–17*d* show a second alternate embodiment of the present invention.
Figure 17B:
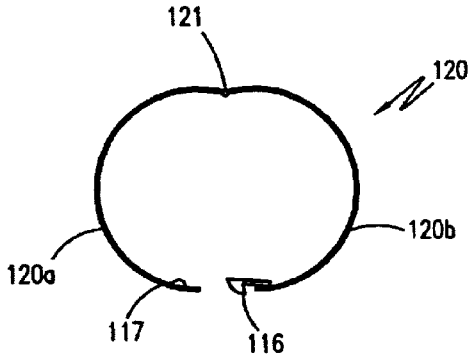
Figure 17C:
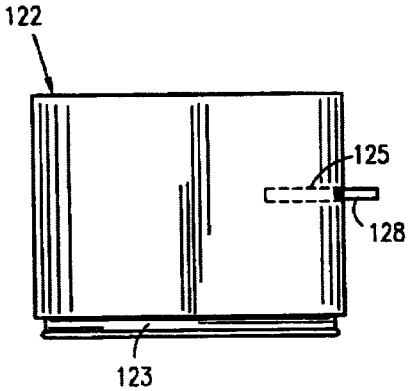
Figure 17D:
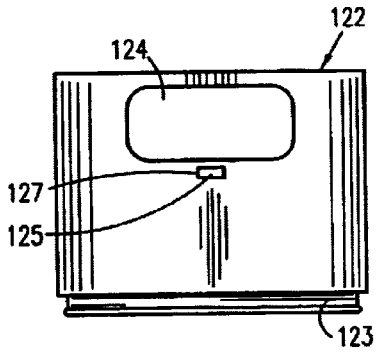

Referring now more specifically to FIGS. 17*c* and 17*d*, the second alternate embodiment is further defined as having a cylindrical spray apparatus housing 122 designed to be removably attached to the protective cylinder 120. The spray apparatus housing 122 includes a lip receiving groove 123 formed circumferentially around a lower portion thereof. The lip receiving groove 123 is designed to frictionally engage the lip 142 of the protective cylinder 120 in a semi-interference type fit. Thus, when attached to the upper plate 76, the spray apparatus housing 122 protectively covers the spray apparatus 20 and an upper portion of the reservoir cylinder 30. The spray apparatus housing 122 includes an opening 124 formed along an external circumferential sidewall thereof, sized so as to reveal the spray nozzle 28 and trigger 29 of the spray apparatus 20. A trigger actuation bar 125 extends through a hole 127 in a front sidewall of the spray apparatus housing 122 and is biased lateral thereto by spring 128. Depressing the trigger actuation bar 125 by a finger of the user engages the trigger 29 to dispense cleaning fluid.

The protective cylinder 120 and the spray apparatus housing 122 in conjunction provide a means for keeping paper towels clean and dry and also provide a pleasing, streamlined aesthetic appearance.

Figure 18A:
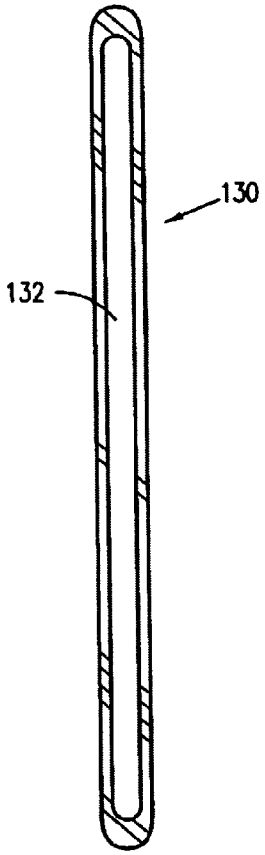
FIGS. 18*a*–18*c* show a third alternate embodiment of the present invention.
Figure 18B:
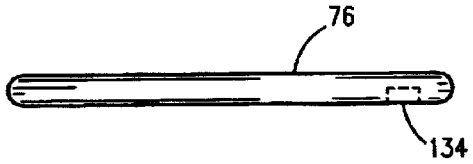
Figure 18C:
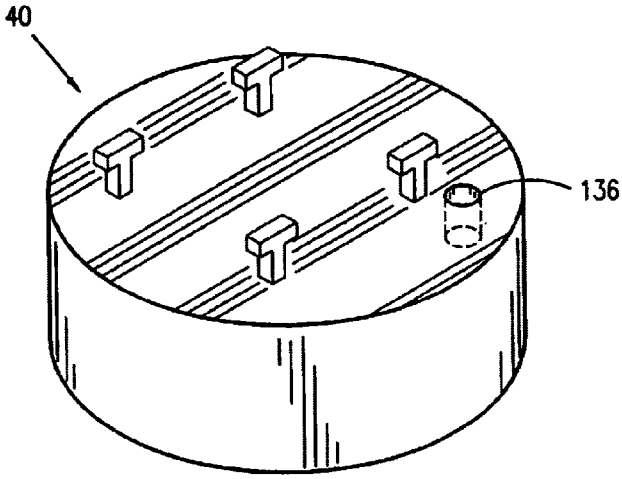

Referring now to FIGS. 18*a*–18*c*, a third alternate embodiment of the present invention is shown for restraining a roll of paper towels as well as providing a means for easily tearing single sheets therefrom. A linearly elongated spindle rod 130 of uniform diameter includes an elongated slot 132 formed therein for feeding paper towels therethrough. Being narrow in design, the slot 132 provides a means for securely holding paper towels and for facilitating tearing of individual sheets therefrom.

A first sleeve 134 is formed in the lower surface of the upper plate 76 with a diameter slightly larger than the diameter of the spindle rod 130 so as to allow removable insertion of an upper end of the spindle rod 130 therein. A second sleeve 136 is formed on the upper surface 42 of the base 40, aligned linearly with respect to the first sleeve 134, with a diameter sized equal to the first sleeve 134 so as to allow removable insertion of a lower end of the spindle rod 130 therein. The spindle rod 134 is designed and configured so as to be freely rotatable about its sleeves 134, 136.

Figure 19:
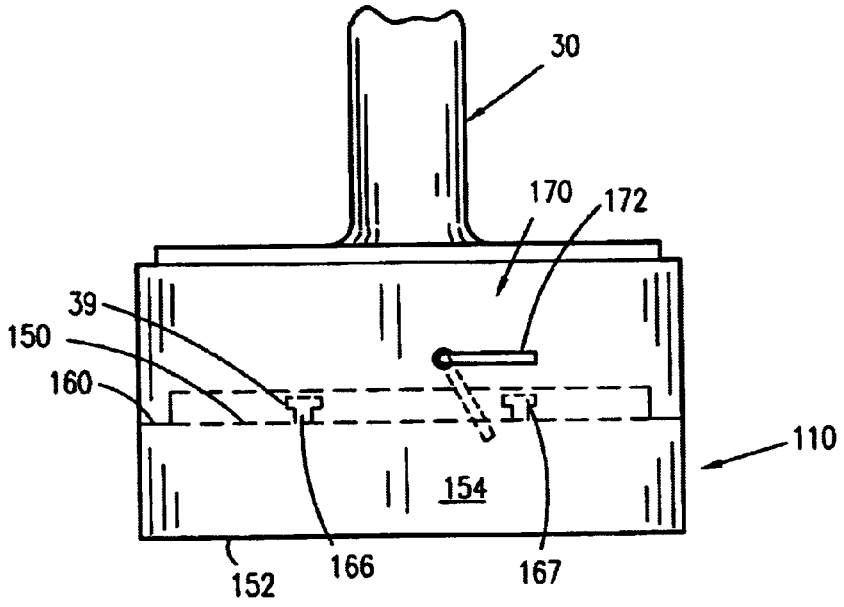
FIG. 19 shows a fourth alternate embodiment of the present invention.

Referring now to FIG. 19, in order to facilitate utilization of the present invention as a stationary towel dispenser, a fourth alternate embodiment of the present invention is shown, wherein a rubber suction base 110 is provided for being removably secured to the reservoir cylinder 30, thus supporting the reservoir cylinder 30 in an upright manner on a counter top or other level surface.

The rubber suction base 110 is of a circular, hollow configuration having an upper surface 150 opposite a lower surface 152 and a circular apron 154 which is defined as a vertical sidewall which extends circumferentially therearound.

The rubber suction base 110 includes attachment stems 166 molded integral to the upper surface 150 thereof which extend perpendicularly therefrom. Each attachment stem 166 comprises a circular, flattened head 167 adapted so as to be snugly received by a corresponding fastener 39 of the reservoir cylinder 30.

An upper, outer perimeter of the rubber suction base 110 is defined as having a skirt structure receiving edge 160 formed peripherally therearound as an angular recess between an upper surface 150 of the rubber suction base 110 and a circular apron 154 thereof.

The base receiving edge 38 of the skirt structure 33 of the reservoir cylinder 30 is designed to coincide with the skirt structure receiving edge 160 of the rubber suction base 110 in such a manner whereby adjoinment of the reservoir cylinder 30 to the rubber suction base 110 forms a smooth outer surface at an outer adjoinment point thereof.

In order to effectuate securement of the reservoir cylinder 30 to the rubber suction base 110, a user aligns the reservoir cylinder 30 directly above the upper surface 150 of the rubber suction base 110 in such a manner wherein the heads 167 of the attachment stems 166 reside just shy a head receiving slot 39*a* formed in each fastener 39. The user then simply rotates the reservoir cylinder 30 approximately ⅛ turn in a clockwise direction, thereby securing the heads 167 of the attachment stems 166 within the fasteners 39, and effectively securing the reservoir cylinder 30 to the rubber suction base 110.

The fourth alternate embodiment of the present invention is further defined as having a surface disengagement means 170 which is defined as a lever 172 rotatably mounted to the circular apron 36 of the reservoir cylinder 30. Clockwise rotation of the lever 172 actuates disengagement of the rubber suction base 110 from the level surface. Counter-clockwise rotation of the lever 170 allows the rubber suction base 110 to be grippingly held to the level surface.

2. Operation of the Preferred Embodiment

To use the present invention, the user aligns the reservoir cylinder 30 directly above the upper surface 42 of the base 40 in such a manner wherein the heads 41*a* of the attachment stems 41 reside just shy a head receiving slot 39*a* formed in each fastener 39. The user then simply rotates the reservoir cylinder 30 approximately ⅛ turn in a clockwise direction, thereby securing the heads 41*a* of the attachment stems 41 within the fasteners 39, and effectively secures the reservoir cylinder 30 to the base 40. The user then fills the reservoir cylinder 30 with cleaning fluid; slides a roll of paper towels 60 over the reservoir cylinder 30 such that the lower end thereof rests against the upper surface 35 thereof; feeds a loose sheet end of the towel roll through the towel receiving slot 74; slides the upper plate 76 over the reservoir cylinder 30 such that a lower surface of the upper plate 76 rests against an upper end of the paper towels 60 and wherein an anterior end 72 of the retaining rod 71 is slidably received within the oval-shaped hole 77 formed in the upper plate 76; slides the syphon tube 27 within the reservoir cylinder 30 and attaches the spray apparatus 20 thereto. Next, the user tears a single sheet from the roll of paper towels 60, and sprays a soiled area to be cleaned via the spray apparatus 20. The user then wipes clean the soiled area and places the used paper towel in the storage compartment 46 via the large opening 47. When the storage compartment 46 is filled, the user depresses the button 64 which actuates the trap door 49 to swing downward to an open position. The trap door 49 facilitates an easy manner for discarding used paper towels stored within the storage compartment 46 of the base 40 when near a trash collection bin or other waist receiving container in a quick and efficient manner.

In the event the user's hands are occupied, a convenient nylon shoulder strap 100 with plastic hook ends 102 is provided. The user connects the hook ends 102 of the strap 100 to apertures 104, 106 formed near opposed edges of upper plate 76, and along opposed edges of the top side 42 of the base 40 respectively, and places the strap 100 over a shoulder, thereby facilitating hands-free transportation of the present invention.

The use of the present invention provides a means for one person to quickly clean windows in a safe, easy, and effective manner.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A combined portable cleaning fluid spray apparatus and paper towel support and dispensing apparatus comprising:

a manually actuable spray apparatus in fluid communication with a cleaning fluid reservoir cylinder;

said cleaning fluid reservoir cylinder of a linearly elongated, hollow tubular configuration forming a reservoir cylinder designed and configured for both storing a supply of cleaning fluid and for supporting a roll of paper towels in an upright manner, said cleaning fluid reservoir cylinder capable of being insertable within a hollow center of a roll of paper towels in such a manner wherein the hollow center slidably receives the reservoir cylinder and further acts as an axis about which a roll of paper towels rotates; and a base terminating a lower portion of said cleaning fluid reservoir cylinder, wherein said reservoir cylinder is further defined as having a circular skirt structure molded integral therewith which extends radially from a sidewall of a lower portion thereof, thereby forming said base, wherein an upper, outer perimeter of said skirt structure is defined as having a cylindrical housing receiving edge formed peripherally therearound as an angular recess between an upper surface of said skirt structure and a circular apron thereof; and a lower, inner perimeter of said skirt structure is defined as having a base receiving edge formed peripherally therearound as an angular recess between a lower surface of said skirt structure and a lower inner sidewall of the circular apron thereof.

2. The combined portable cleaning fluid spray apparatus and paper towel support and dispensing apparatus of claim 1, further comprising a plurality of C-shaped, hollow, sleeved fasteners molded integral to the lower surface of the skirt structure, said fasteners designed so as to slidably receive corresponding attachment stems of said base.

3. The combined portable cleaning fluid spray apparatus and paper towel support and dispensing apparatus of claim 1, wherein said manually actuable spray apparatus is frictionally attached to the reservoir cylinder through the provision of the reservoir cylinder being provided with a threaded male fitting located at an upper end thereof for threadably engaging a threaded female fitting provided on a lower side of a spray head of the spray apparatus.

4. The combined portable cleaning fluid spray apparatus and paper towel support and dispensing apparatus of claim 1, further comprising a fluid pump located within the spray head for forcing cleaning fluid from said reservoir cylinder into and through a flexible syphon tube and exiting a spray nozzle.

5. The combined portable cleaning fluid spray apparatus and paper towel support and dispensing apparatus of claim 1, wherein said fluid pump includes a depressible trigger pivotally attached via a pivot pin to said spray head, and wherein said trigger extends outward through a slot provided in the spray head; and a syphon tube of a linearly elongated configuration and extends downward to a position near a bottom of the reservoir cylinder, said syphon tube in fluid communication with said spray nozzle.

6. The combined portable cleaning fluid spray apparatus and paper towel support and dispensing apparatus of claim 5, wherein said trigger is connected to the fluid pump via a push rod which actuates the fluid pump.

7. A combined portable cleaning fluid spray apparatus and paper towel support and dispensing apparatus comprising:

a manually actuable spray apparatus in fluid communication with a cleaning fluid reservoir cylinder;

said cleaning fluid reservoir cylinder of a linearly elongated, hollow tubular configuration forming a reservoir cylinder designed and configured for both storing a supply of cleaning fluid and for supporting a roll of paper towels in an upright manner, said cleaning fluid reservoir cylinder capable of being insertable within a hollow center of a roll of paper towels in such a manner wherein the hollow center slidably receives the reservoir cylinder and further acts as an axis about which a roll of paper towels rotates; and a base terminating a lower portion of said cleaning fluid reservoir cylinder;

wherein said base is of a circular, hollow configuration fabricated of a rigid plastic material with an upper surface opposite a lower surface and a circular apron which forms a used towel storage compartment.

8. The combined portable cleaning fluid spray apparatus and paper towel support and dispensing apparatus of claim 7, wherein a large circular opening is formed along said circular apron for providing entry into said storage compartment, wherein used towels are inserted through the opening and stored within said compartment.

* * * * *